US007310077B2

(12) United States Patent
Kane

(10) Patent No.: US 7,310,077 B2
(45) Date of Patent: Dec. 18, 2007

(54) PIXEL CIRCUIT FOR AN ACTIVE MATRIX ORGANIC LIGHT-EMITTING DIODE DISPLAY

(76) Inventor: Michael Gillis Kane, 44 Robin Dr., Skillman, NJ (US) 08558

( * ) Notice: Subject to any disclaimer, the term of this patent is extended or adjusted under 35 U.S.C. 154(b) by 610 days.

(21) Appl. No.: 10/953,087

(22) Filed: Sep. 29, 2004

(65) Prior Publication Data

US 2005/0067971 A1 Mar. 31, 2005

Related U.S. Application Data

(60) Provisional application No. 60/507,060, filed on Sep. 29, 2003.

(51) Int. Cl.
*G09G 3/30* (2006.01)

(52) U.S. Cl. ..... 345/76; 345/82

(58) Field of Classification Search ..... 345/36, 345/48, 76, 77, 82, 84, 204
See application file for complete search history.

(56) References Cited

U.S. PATENT DOCUMENTS

| | | | |
|---|---|---|---|
| 3,590,156 | A | 6/1971 | Easton |
| 3,761,617 | A | 9/1973 | Tsuchiya et al. |
| 4,006,383 | A | 2/1977 | Luo et al. |
| 4,114,070 | A | 9/1978 | Asars |
| 4,528,480 | A | 7/1985 | Unagami et al. |
| 4,532,506 | A | 7/1985 | Kitazima et al. |
| 4,554,539 | A | 11/1985 | Graves |
| 4,652,872 | A | 3/1987 | Fujita |
| 4,736,137 | A | 4/1988 | Ohwada et al. |
| 4,797,667 | A | 1/1989 | Dolinar et al. |
| 4,958,105 | A | 9/1990 | Young et al. |
| 4,962,374 | A | 10/1990 | Fujioka et al. |
| 4,963,861 | A | 10/1990 | Thioulouse et al. |
| 4,975,691 | A | 12/1990 | Lee |
| 5,003,302 | A | 3/1991 | Richard et al. |
| 5,028,916 | A | 7/1991 | Ichikawa et al. |

(Continued)

FOREIGN PATENT DOCUMENTS

| | | |
|---|---|---|
| EP | 0 653 741 | 5/1995 |

(Continued)

OTHER PUBLICATIONS

T. Sasaoka et al, "24.4L: Late-News Paper: A 13.0-inch AM-OLED Display with Top Emitting Structure and Adaptive Current Mode programmed Pixel Circuit (TAC)," SID 01 Digest, 2001, pp. 384-387.

(Continued)

*Primary Examiner*—Richard Hjerpe
*Assistant Examiner*—Jean Lesperance
(74) *Attorney, Agent, or Firm*—Berkeley Law & Technology Group, LLP

(57) ABSTRACT

A pixel circuit for an OLED element comprises first, second, third and fourth transistors wherein controllable conduction paths of the first and second transistors are connected for receiving a data signal current, and the control electrodes thereof are connected for receiving a select signal for being enabled thereby. The third and/or fourth transistors are connected for establishing a current in the OLED element responsive to the data signal current and the select signal. Capacitance may be provided by at least one of the transistors or by additional capacitance.

27 Claims, 2 Drawing Sheets

U.S. PATENT DOCUMENTS

| | | | | |
|---|---|---|---|---|
| 5,063,378 | A | 11/1991 | Roach | |
| 5,079,483 | A | 1/1992 | Sato | |
| 5,095,248 | A | 3/1992 | Sato | |
| 5,172,032 | A | 12/1992 | Alessio | |
| 5,218,464 | A | 6/1993 | Hiroki et al. | |
| 5,302,966 | A | 4/1994 | Stewart | |
| 5,463,279 | A | 10/1995 | Khormaei | |
| 5,670,979 | A | 9/1997 | Huq et al. | |
| 5,684,365 | A | 11/1997 | Tang et al. | |
| 5,723,950 | A | 3/1998 | Wei et al. | |
| 5,903,246 | A | 5/1999 | Dingwall | |
| 5,952,789 | A | 9/1999 | Stewart et al. | |
| 5,959,599 | A | 9/1999 | Hirakata | |
| 6,229,506 | B1 | 5/2001 | Dawson et al. | |
| 6,229,508 | B1 | 5/2001 | Kane | |
| 6,501,466 | B1 | 12/2002 | Yamagishi et al. | |
| 6,542,142 | B2 | 4/2003 | Yumoto et al. | |
| 6,583,775 | B1 | 6/2003 | Sekiya et al. | |
| 6,618,030 | B2 | 9/2003 | Kane et al. | |
| 6,686,699 | B2 | 2/2004 | Yumoto | |
| 6,750,833 | B2 * | 6/2004 | Kasai | 345/76 |
| 6,897,838 | B2 * | 5/2005 | Okamoto | 345/76 |
| 2002/0196211 | A1 | 12/2002 | Yumoto | |
| 2003/0107560 | A1 | 6/2003 | Yumoto et al. | |
| 2003/0128200 | A1 | 7/2003 | Yumoto | |

FOREIGN PATENT DOCUMENTS

| | | |
|---|---|---|
| EP | 0 731 444 | 9/1996 |
| EP | 0 755 042 | 1/1997 |
| EP | 0 778 556 | 6/1997 |
| EP | 1 130 565 | 9/2001 |

OTHER PUBLICATIONS

Yi He et al, "Current-Source a -Si:H Thin-Film Transistor Circuit for Active-Matrix Organic Light-Emitting Displays," IEEE Electron Device Letters, vol. 21, No. 12, Dec. 2000, pp. 590-592.

James L. Sanford et al, "4.2: TFT AMOLED Pixel Circuits and Driving Methods," SID 03 Digest, 2003, pp. 10-13.

D. Fish et al, "32.1: Invited Paper: A Comparison of Pixel Circuits for Active Matrix Polymer/Organic LED Displays," SID 02 Digest, 2002, pp. 968-971.

Masuyuki Ohta et al, "9.4: A Novel Current programmed Pixel for Active Matrix OLED Displays," SID 03 Digest, 2003, pp. 108-111.

R.M.A. Dawson et al, "The Impact of the Trasient Response of Organic Light Emitting Diodes on the Design of Active Matrix OLED Displays," IEEE International Electronic Device Meeting 1998, pp. 875-878.

Jae-Hoon Lee et al, P-71: OLED Pixel Design Employing a Novel Current Scaling Scheme, SID 03 Digest, 2003, pp. 490-493.

W.K. Kwak et al, "9.2: A 5.0-in WVGA AMOLED Display for PDAs," SID 03 Digest, pp. 100-103.

Hiroshi Kageyama et al, "9.1: A 3.5-inch OLED Display using a 4-TFT Pixel Circuit with an Innovative Pixel Driving Scheme," SID 03 Digest, 2003, pp. 96-99.

R. Dawson et al, "Amorphous Silicon Active Matrix Organic Light Emitting Diode (AMOLED) Displays Preliminary Program Report," Final Version, Oct. 31, 1998, 17 Pages.

A. Nathan et al, "Amorphous Silicon Back-Plane Electronics for OLED Displays," IEEE Journal Of Selected Topics In Quantum Electronics, vol. 10, No. 1, Jan./Feb. 2004, pp. 58-69.

* cited by examiner

PIXEL CIRCUIT FOR AN ACTIVE MATRIX ORGANIC LIGHT-EMITTING DIODE DISPLAY

This Application claims the benefit of U.S. Provisional Application Ser. No. 60/507,060 filed Sep. 29, 2003.

The present invention relates to a pixel circuit, and in particular to a pixel circuit suitable for an active matrix display.

Passive matrix organic light-emitting diode (OLED) displays suffer from a limitation in the number of lines (i.e. rows) in a display due to activation of one line at a time thereby to require a high current flow needed to provide moderate average current to each line. An active-matrix OLED (AMOLED) display substantially mitigates these problems because the OLED pixels can operate all the time. Analog data is written into the AMOLED pixel array one row at a time, but the OLEDs thereof are operated at essentially 100% duty cycle. This is accomplished by providing an analog memory circuit for each pixel using active devices, i.e. transistors.

Many existing AMOLED pixels and drive schemes apply to voltage-programmed displays. A voltage-programmed display is one in which the analog data that is applied to the display is applied as a voltage. The alternative is a current-programmed display, wherein the analog data is applied to the display as a current.

All active-matrix liquid-crystal displays (AMLCDs) are voltage-programmed, because the liquid-crystal is a voltage-sensitive element. It is like a capacitor whose electro-optic properties are sensitive to the voltage across it. But an OLED is different. The brightness of an OLED element depends primarily on the current through it, and only secondarily on the voltage that is applied in order to produce that current. In an AMOLED display there are transistors in each pixel circuit, and the programming of the pixel circuit to drive the desired current through the OLED is accomplished by applying a voltage to the transistors in the pixel circuit (for a voltage-programmed pixel), or by applying a current to the transistors in the pixel circuit (in a current-programmed pixel). Of course, the configuration of the transistors in the pixel will be different in the two cases.

In a voltage-programmed display, the data applied to the data lines, i.e. columns, is a voltage, not a current, and it is much faster to charge the large capacitance associated with the column to its steady-state voltage from a voltage source than from a current source. (Even with current programming, the column capacitance must be charged to its steady-state voltage before the pixel can be considered programmed, because until the capacitance is charged, some of the programming current is being diverted to charge the column capacitance rather than to program the pixel.) The main disadvantage of current-programmed AMOLED pixels is the difficulty of charging the column within a line time.

On the other hand, in a voltage-programmed display pixel the analog data is applied as a voltage, but it must be converted to a current that will be driven through the OLED element. This voltage-to-current conversion is performed by a transistor relying on its transconductance, a small-signal quantity $g_m=\Delta I/\Delta V$ that represents the ratio of current-output to voltage-input at a given bias level, so that the OLED element current will vary with the transconductance of a transistor in the pixel circuit. Because transconductance depends on such factors as the mobility of the transistor and the gate capacitance, which can vary across the display thereby creating nonuniformity within a display, and from display to display, requiring each display module to be individually adjusted at the factory. In addition, voltage programmed pixels can also have sensitivity to transistor threshold voltage, which varies across the display and from display to display, which also produces similar display nonuniformity.

In a current-programmed pixel, however, non-uniformity in the transconductance of the transistor does not necessarily produce non-uniformity in the display. The analog data signal is applied as a current, and this value of current (or some fixed multiple of it) is applied to the OLED element and so transistor non-uniformities are not a problem. However, certain prior-art current-programmed pixels can have a secondary problem with transistor nonuniformities because of mismatch between the two transistors forming a current mirror in the pixel circuit.

FIG. 1 is an electrical circuit schematic diagram of a prior art pixel circuit 10 which operates as follows. When the pixel is to be programmed, both select lines A and B are pulsed high. A programming current I is drawn from the data line by the column driver circuit. Since all other pixels in this column are unselected, the current I flows through transistors P1 and N2 (once the column and pixel have been charged to a stable voltage). Since transistor N1 is on at this time, transistor P1 self-biases to a gate-to-source voltage that sets its drain current to equal the programming current I. Then select lines A and B are turned off, and the voltage on the gate of transistor P1 is stored there with the help of capacitor C. Since transistor P2 is matched to transistor P1, and they share the same gate-to-source voltage, and assuming transistor P2 is kept in saturation, the OLED drive current is now set to the same value as the programming current I, or a fixed multiple thereof, depending on the size ratios of transistors P1 and P2. (This configuration of two transistors is known as a current mirror, because the current flowing through transistor P1 is "mirrored" by that flowing through transistor P2.) This current through the OLED element continues to flow while transistors N1 and N2 are off. The overall brightness of the display can be scaled down by pulsing select line B prior to the time for programming the pixel again, one frame time later. This turns on transistor N1 without turning on transistor N2, so that transistor P1 self-biases to zero current, and the current through transistor P2 and the OLED drops to zero as well for the rest of the frame time.

To reduce the disadvantage of longer charging time of a current-programmed OLED display driven from a fixed current source, the column charging time may be reduced by using a programming current I that is larger than the desired OLED current. The ratio of the channel width of transistor P1 to that of transistor P2 in the current mirror (e.g., the "width ratio" of P1 to P2) may be used to scale the programming current down to the appropriate level. Thus, transistor P1 might be five times wider than transistor P2, and the programming current I is set by the driver chip to be five times higher than the desired OLED current, so that five times the program current is available to charge the data line capacitance.

Disadvantageously, prior art pixel circuit 10 must be fabricated using a polysilicon technology because it has two p-channel devices, which can not be made using an amorphous-silicon (a-Si) thin-film transistor (TFT) technology. Amorphous silicon TFT processing is more readily available and is lower in cost than polysilicon TFT processing, but a-Si TFTs are only available as n-channel devices. The p-channel devices in this prior art pixel circuit 10 cannot simply be replaced with n-channel devices, with appropriate circuit changes, because this will place the OLED (whose anode is accessible to the transistors) in the source of the n-channel transistor, and the prior art circuit 10 will not work.

Accordingly, it would be desirable to have a pixel circuit that may utilize only n-channel transistors so as to be compatible with a-Si TFT processing, e.g., by permitting the OLED to be in the source of the current mirror transistors, as well as compatible with polysilicon processing. It would also be desirable to have an improved pixel circuit that may utilize n-channel transistors and p-channel transistors that can be fabricated with polysilicon processing.

To this end, a pixel circuit for an OLED element comprises first, second, third and fourth transistors wherein controllable conduction paths of the first and second transistors are connected for receiving a data signal current, and the control electrodes thereof are connected for receiving a select signal for being enabled thereby. The third and/or fourth transistors are connected for establishing a current in the OLED element responsive to the data signal current and the select signal. Capacitance may be provided by at least one of the transistors or by additional capacitance.

BRIEF DESCRIPTION OF THE DRAWING

The detailed description of the preferred embodiment(s) will be more easily and better understood when read in conjunction with the FIGURES of the Drawing which include.

Figure 1:
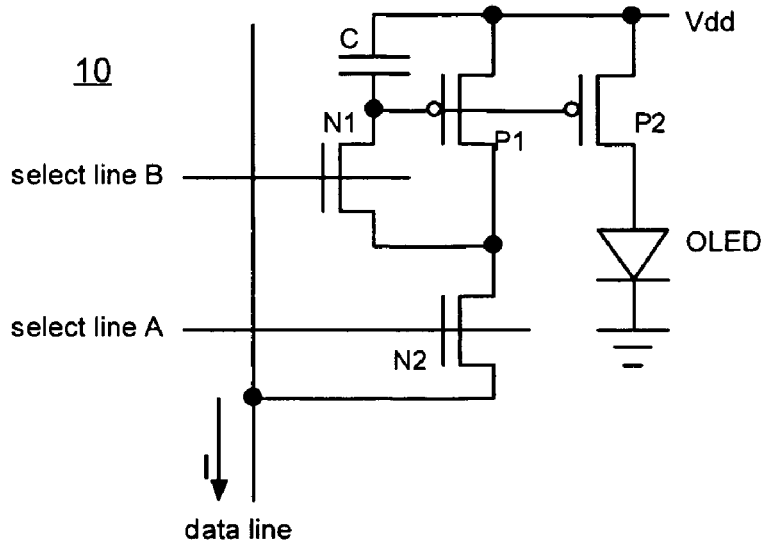
FIGURE 1 (PRIOR ART)
FIG. 1 is an electrical circuit schematic diagram of a prior art pixel circuit.

In the Drawing, where an element or feature is shown in more than one drawing figure, the same alphanumeric designation may be used to designate such element or feature in each figure, and where a closely related or modified element is shown in a figure, the same alphanumerical designation primed. Similarly, similar elements or features may be designated by like alphanumeric designations in different figures of the Drawing. It is noted that, according to common practice, the various features of the drawing are not to scale, and the dimensions of the various features are arbitrarily expanded or reduced for clarity, and any value stated in any Figure is given by way of example only.

DESCRIPTION OF THE PREFERRED EMBODIMENT(S)

Current-programmed AMOLED pixel circuits are described, some of which employ transistors of only one polarity, e.g., only n-channel transistors, which could be provided using amorphous silicon thin-film transistor (a-Si TFT) technology, e.g., as used in conventional AMLCD displays. Alternatively, even though polysilicon processes can produce both n-channel and p-channel transistors, it might be desirable to simplify the polysilcon transistor process by fabricating transistors of only one polarity. Other pixels described herein use transistors of both polarities, i.e. both n-channel and p-channel transistors, which could be provided using conventional CMOS processes, such as a low-temperature polysilicon CMOS process.

A current mirror circuit provides a current through the OLED pixel element that is a predetermined multiple of the programming current, wherein the multiplier may be unity or may be greater or less than unity. Good matching is required of the two transistors in the current mirror, so that the OLED current is a well-defined function of the programming current. However, in polysilicon it is difficult to get two transistors to match, even if they are next to each other, because the random grain structure of the polysilicon material produces "random" device variations. As a result, the OLED element current may have a "random" component, and the display can be nonuniform.

The pixels described herein address this need for matching in two different ways: (a) by using a current mirror formed of n-channel transistors, which are compatible with amorphous silicon processing and therefore do not manifest the random nonuniformities of polysilicon transistors, or (b) by utilizing the same transistor to both receive the programming current and, after programming, to drive current through the OLED element, so that no matching problem arises.

Plural pixel circuits described are typically arranged in rows or lines of a scanned display. The time taken to scan each row (line) is referred to as the line time or select interval, and the time taken to scan all rows (lines) of a display is referred to as the frame time. Each pixel circuit is programed to provide a current that is a scaled value of a programming or data current applied thereto during a line time which is a portion of the frame time in a scanned display. Each pixel is typically "refreshed" or reprogrammed during the line time and the line time is 1/N of the frame time where there are N lines in the display.

Figure 2:
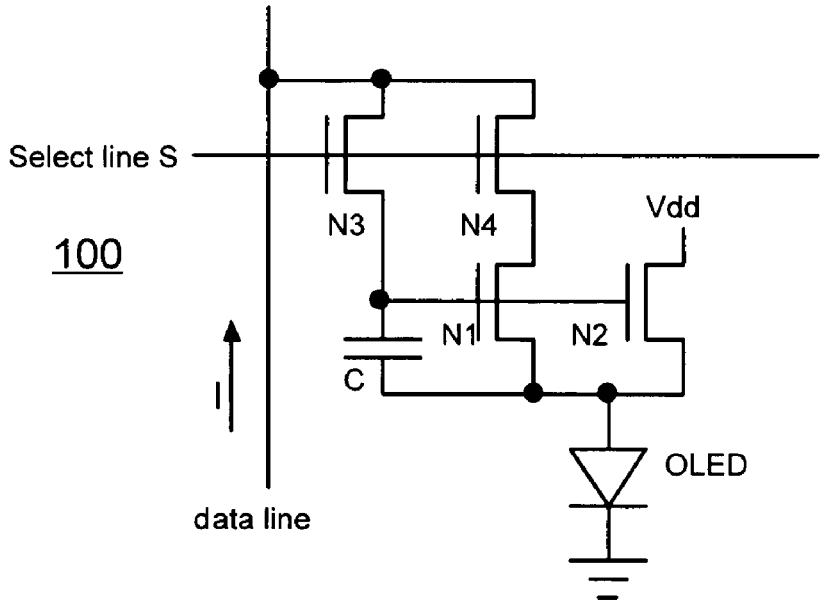
FIG. 2 is an electrical circuit schematic diagram of an example embodiment of a pixel circuit.

FIG. 2 is an electrical circuit schematic diagram of an example embodiment of a pixel circuit 100. An AMOLED pixel employs a current-programmed current mirror N1, N2 in which the OLED element is in the source of the mirror transistors N1, N2. The circuit 100 shown uses n-channel transistors, although one skilled in the art could translate the circuit into an implementation with p-channel transistors. However, because OLED technology typically makes the anode of the OLED elements accessible to the transistors, n-channel transistor technology is more natural. Circuit 100 is thus compatible with a-Si TFT processing.

Operation of circuit 100 is as follows. When the row is selected, the select line S is pulsed high, turning on transistors N3 and N4, and a programming or data current I is driven down the row by the column driver circuit via the data line conductor. After the column line and pixel capacitances are charged, this data current I flows through transistors N4, N1, and the OLED element. A gate-to-source voltage is established on transistor N1 that is the proper voltage value for establishing a drain current of value I to flow through transistor N1. At the same time a current flows through transistor N2 that is a scaled version of the current I flowing through transistor N1, depending on the size ratios of transistors N2 to N1, since their gates are connected in parallel and so receive the same gate-to-source voltage, as long as both transistors are kept in saturation.

At the end of the line time, i.e. the time in which the current flowing in element OLED is established responsive to the data current I, the select pulse on the select line S becomes low, and transistors N3 and N4 are turned off. The gate-to-source voltage at the gate of transistors N1 and N2 is stored on capacitor C. Amorphous silicon transistors, such as transistors N1, N2, typically exhibit relatively large capacitances between their gate and source/drain electrodes, and so a separate element providing a capacitance C may not be necessary. Thus the current flowing through the OLED element is programmed to the desired level, i.e. a scaled values responsive to data current I. The ratio of the width of transistor N2 to that of transistor N1 establishes the ratio of programming current I to the OLED current, i.e. the scaling factor. The column convergence time can be improved by increasing this ratio, thus increasing the programming current.

It is noted that one end of the respective controllable conduction paths of transistors N3 and N4 of circuit 100 are connected together for receiving data signal current I. When transistors N3 and N4 are enabled, each is capable of conducting all or part of data signal current I, however, at or before the end of the line time all or substantially all of data signal current I flows through transistors N4 and N1. Preferably, this current reaches a substantially steady state condition, and the scaled current that flows in the element OLED responsive to data signal current I also reaches a substantially steady state condition, e.g., at a value that is substantially the desired scaled value of data line current I.

At the end of the select interval during which transistors N3, N4 are enabled by the select line S being high, the current through the OLED element drops by the amount I of the data current as transistor N1 is turned off by the select line S becoming low, and the voltage across the OLED also decreases somewhat. Preferably, the capacitor C, together with the gate-to-source capacitance of transistors N1 and N2, is sufficiently large so that the voltage change across the OLED after the end of the select interval will not substantially change the gate-to-source voltage across transistor N2, so its current will remain substantially the same until the next select interval.

A pixel circuit 100 for an OLED element may comprise an OLED element and first and second transistors N3, N4 of a first polarity. Each of the first and second transistors N3, N4 has a controllable conduction path and a control electrode for controlling the conduction of the controllable conduction path. One end of the controllable conduction paths of the first and second transistors N3, N4 are connected together for receiving a data signal current I and the control electrodes of the first and second transistors N3, N4 are connected to each other for receiving a select signal for being enabled thereby. Third and fourth transistors N1, N2 each have a controllable conduction path and a control electrode for controlling the conduction of the controllable conduction path, and at least one of the third and fourth transistors N1, N2 exhibits a capacitance between its control electrode and its conduction path. One end of the controllable conduction paths of the third and fourth transistors N1, N2 are connected together and to an OLED element. The control electrodes of the third and fourth transistors N1, N2 are connected to each other and to the other end of the controllable conduction path of the first transistor N3 and the other end of the controllable conduction path of the third transistor N1 is connected to the other end of the controllable conduction path of the second transistor N4. As a result, a current is established in the OLED element is responsive to the data signal current I when the first and second transistors N3, N4 are enabled by the select signal.

Pixel circuit 100 may further comprise a capacitance C coupled between the one end of the controllable conduction path of the third transistor N1 and the control electrode thereof. The third and fourth transistors N1, N2 may be of the first polarity. The one ends of the controllable conduction paths of the third and fourth transistors N1, N2 may be connected to the anode of the OLED element, and a cathode of the OLED element and the other end of the controllable conduction path of the fourth transistor N2 may be coupled for receiving a potential Vdd therebetween.

The pixel circuit 100 may be in combination with a plurality of like pixel circuits 100 arranged in rows and columns to define a display having a plurality of OLED pixel elements, and row conductors may be associated with pixel circuits 100 in each row of the display and column conductors associated with pixel circuits in each column of the display. Therein, the column conductors may apply the data signal current I and the row conductors may apply the select signal.

One or more pixel circuits 100 may be embodied, for example, in an amorphous-silicon circuit, in a poly-silicon circuit, or in a single-crystal silicon circuit.

Although the pixel circuit 100 illustrated in FIG. 2 would likely be subject to unpredictable matching between the two transistors N1, N2 in the current mirror if implemented in polysilicon technology, if implemented in amorphous silicon (a-Si) technology the matching between these two transistors N1, N2 is expected to be better, because a-Si does not have a grain structure as does polysilicon. However, the AMOLED pixel circuit 100' illustrated in FIG. 3 avoids this transistor matching problem entirely by using the same transistor P1 for current-programming and for driving the OLED.

Figure 3:
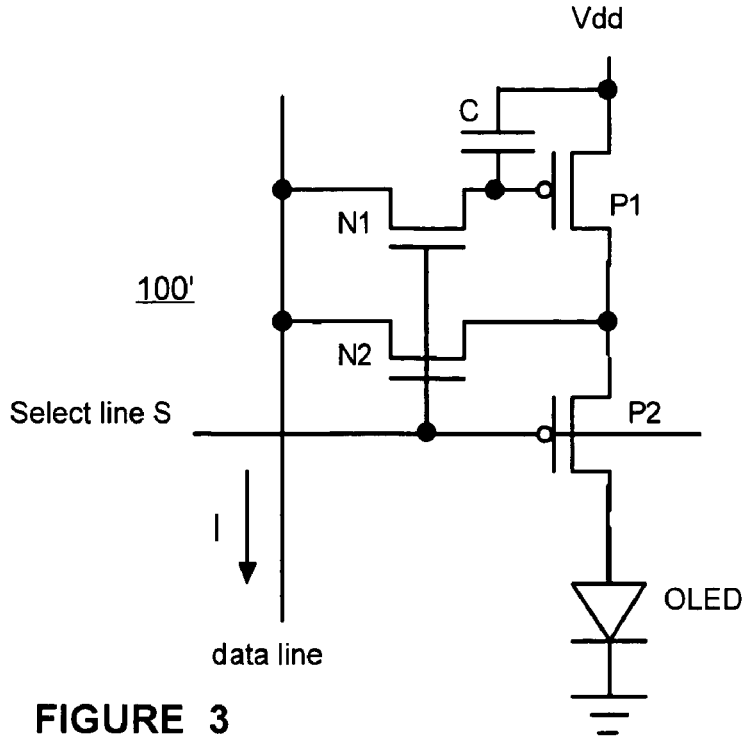
FIG. 3 is an electrical circuit schematic diagram of an example embodiment of a pixel circuit.

FIG. 3 is an electrical circuit schematic diagram of an example embodiment of a pixel circuit 100'. In pixel circuit 100' the select line S is pulsed high in order to program the current to element OLED provided by pixel circuit 100'. When the select line S is high, n-channel transistors N1 and N2 turn on, and p-channel transistor P2 turns off. A programming current I is drawn from the data line by the column drive circuit (not shown), and this current flows from p-channel transistor P1 to the data line via transistor N2, once steady state voltages are reached on the column data line and in the pixel element OLED. This sets a gate-to-source voltage on transistor P1 that corresponds to the programming current I flowing in the data line.

At the end of the line time the select line S signal returns low, turning transistors N1 and N2 off, and turning transistor P2 on, thereby allowing the programmed current I to flow in the OLED. A capacitor C is included in pixel circuit 100' to help store the voltage on the gate of transistor P1. Polysilicon transistors such as transistor P1 typically have a relatively small gate-to-source capacitance, and so a capacitor C will be typically be needed.

While pixel circuit 100' deals well with the current mirror matching problem, e.g., by utilizing transistor P1 to both establish the appropriate gate-to-source voltage and to conduct the programming current I and the programmed current, slow column charging might be a problem under certain conditions. Pixel circuit 100' cannot deal with this problem by using a programming current I that is larger than the OLED current because the same transistor P1 is used for programming and for driving the OLED element. However, even though the programming current I must be the same as the OLED drive current, the voltage swing required on the column, i.e. on the data line conductor, can be reduced, which allows the column convergence to the final current value I to be sped up. By increasing the width of the conduction channel of transistor P1 the voltage swing can be made very small, and so the column can be charged more quickly.

It is noted that one end of the respective controllable conduction paths of transistors N1 and N2 of circuit 100' are connected together for receiving data signal current I. When transistors N1 and N2 are enabled, each is capable of conducting all or part of data signal current I, and transistor P2 is not enabled, however, at or before the end of the line time all or substantially all of data signal current I flows through transistors N2 and P1. Preferably, this current reaches a substantially steady state condition, and the current that flows in transistors P1, P2 and in the element OLED responsive to data signal current I when transistors N1 and N2 are not enabled and transistor P2 is enabled also reaches a substantially steady state condition, e.g., at a value that is substantially the value of data line current I.

A pixel circuit for an OLED element comprises first and second transistors N1, N2 of a first polarity, each of the first and second transistors having a controllable conduction path and a control electrode for controlling the conduction of the controllable conduction path. One end of the controllable conduction paths of the first and second transistors N1, N2 are connected together for receiving a data signal current I, and the control electrodes of the first and second transistors N1, N2 are connected to each other for receiving a select signal for being enabled thereby. Third and fourth transistors, P1, P2 each have a controllable conduction path and a control electrode for controlling the conduction of the controllable conduction path, and at least the third transistor P1 exhibits a capacitance C between its control electrode and its conduction path. One end of the controllable conduction paths of the third and fourth transistors P1, P2 are connected together and to the other end of the controllable conduction path of the second transistor N2, The control electrode of the third transistor P1 is connected to the other end of the controllable conduction path of the first transistor N1 and the control electrode of the fourth transistor P2 is connected to the control electrodes of the first and second transistors N1, N2 for receiving the select signal for being enabled thereby. The other end of the controllable conduction path of the fourth transistor P2 is connected to the OLED element. As a result, a current is established in the OLED element responsive to the data signal current I when the first, second and third transistors N1, N2, P1 are enabled by the select signal.

Pixel circuit 100' may further comprise a capacitance C coupled between the other end of the controllable conduction path of the third transistor P1 and the control electrode thereof. The third and fourth transistors P1, P2 may be of a second polarity opposite to the first polarity. The other end of the controllable conduction path of the fourth transistor P2 may be connected to an anode of the OLED element, and a cathode of the OLED element and the other end of the controllable conduction path of the third transistor P1 may be coupled for receiving a potential Vdd therebetween.

A plurality of like pixel circuits 100' may be arranged in rows and columns to define a display having a plurality of OLED pixel elements. Row conductors may be associated with pixel circuits 100' in each row of the display and column conductors may be associated with pixel circuits 100' in each column of the display. The column conductors may apply the data signal current I and the row conductors may apply the select signal.

One or more pixel circuits 100' may be embodied in a poly-silicon circuit or in a single-crystal silicon circuit.

Figure 4:
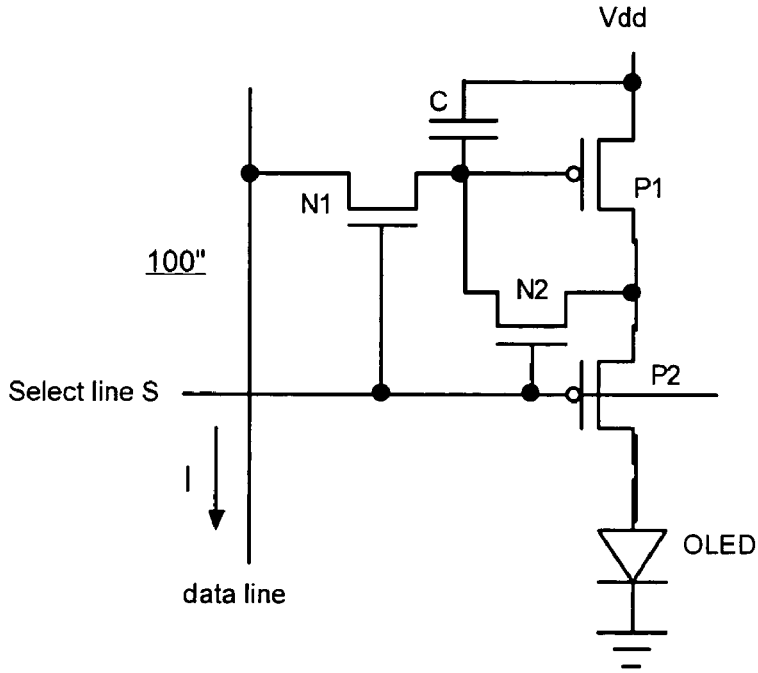
FIG. 4 is an electrical circuit schematic diagram of an example embodiment of a pixel circuit.

FIG. 4 is an electrical circuit schematic diagram of an example embodiment of a pixel circuit 100". Circuit 100" differs from circuit 100' in that in circuit 100" the side of n-channel transistor N2 that was connected to the data line in circuit 100' is connected to the pixel side of n-channel transistor N1. Otherwise, circuit 100" is similar to circuit 100' and operates in similar manner to circuit 100' as described above.

This arrangement has an advantage in that the total column capacitance is lower than that of circuit 100' which tends to speed up pixel convergence to the final value, however, the charging current for the gate capacitance of p-channel transistor P1, which is drawn from data line current I, must flow through transistor N1 as well as through transistor N2, which tends to slow pixel convergence.

When transistors N1 and N2 of circuit 100" are enabled, each is capable of conducting all or part of data signal current I, and transistor P2 is not enabled, however, at or before the end of the line time all or substantially all of data signal current I flows through transistors N2 and P1. Preferably, this current reaches a substantially steady state condition, so that the current that flows in transistors P1, P2 and the element OLED responsive to data signal current I when transistors N1, N2 are not enabled and transistor P2 is enabled also reaches a substantially steady state condition, e.g., at a value that is substantially the desired value of data line current I.

A pixel circuit 100" for an OLED element comprises first and second transistors N1, N2 of a first polarity, each of the first and second transistors N1, N2 having a controllable conduction path and a control electrode for controlling the conduction of the controllable conduction path. One end of the controllable conduction path of the first transistor N1 is connected for receiving a data signal current I and the other end of the controllable conduction path of the first transistor N1 is connected to one end of the controllable conduction path of the second transistor N2. The control electrodes of the first and second transistors N1, N2 are connected to each other for receiving a select signal for being enabled thereby. Third and fourth transistors P1, P2 each have a controllable conduction path and a control electrode for controlling the conduction of the controllable conduction path, and at least the third transistor P1 exhibits a capacitance C between its control electrode and its conduction path. One end of the controllable conduction paths of the third and fourth transistors P1, P2 are connected together and to the other end of the controllable conduction path of the second transistor N2. The control electrode of the third transistor P1 is connected to the other end of the controllable conduction path of the first transistor N1. The control electrode of the fourth transistor P2 is connected to the control electrodes of the first and second transistors N1, N2 for receiving the select signal for being enabled thereby, and the other end of the controllable conduction path of the fourth transistor P2 is connected to the OLED element. As a result, a current is established in the OLED element responsive to the data signal current I when the first, second and third transistors N1, N2, P1 are enabled by the select signal.

The pixel circuit 100" may further comprise a capacitance C coupled between the other end of the controllable conduction path of the third transistor P1 and the control electrode thereof. In pixel circuit 100" third and fourth transistors P1, P2 may be of a second polarity opposite to the first polarity. Further, the other end of the controllable conduction paths of the fourth transistor P2 may be connected to an anode of the OLED element, and a cathode of the OLED element and the other end of the controllable conduction path of the third transistor P1 may be coupled for receiving a potential Vdd therebetween.

A plurality of like pixel circuits 100" may be arranged in rows and columns to define a display having a plurality of OLED pixel elements. Row conductors may be associated with the pixel circuits 100" in each row of the display and column conductors may be associated with the pixel circuits 100" in each column of the display. The column conductors may apply the data signal current I and the row conductors may apply the select signal.

One or more pixel circuits 100" may be embodied in a poly-silicon circuit or in a single-crystal silicon circuit.

In operating pixel circuits 100' and 100" of FIGS. 3 and 4, it is important that transistors N1, N2, and P2 are turned off nearly simultaneously by a common select line S signal, e.g., so that the voltage stored at the gate of transistor P1 is not corrupted (i.e. either discharged or charged significantly) during the deselect transition of the signal on the select line S. If, in pixel 100" while transistor P2 is off, transistor N1 turns off too much before transistor N2 turns off, some of the charge on capacitor C will drain off through transistor P1 until transistor N2 turns off, thereby reducing the voltage of capacitor C and correspondingly reducing the programmed current that flows in the OLED element. If, while P2 is off, transistor N2 turns off too much before transistor N1, the data current I will draw charge from capacitor C, thereby increasing the voltage of capacitor C and correspondingly increasing the programmed current that flows in the OLED element. On the other hand, if transistor P2 turns on too early, charge will be drawn from C by the OLED element, until transistor N2 is turned off, thereby increasing the voltage of capacitor C and correspondingly increasing the programmed current that flows in the OLED element. However, by using a select line S signal that has a deselect edge transition time that is compatible with the normal speed of transistors N1, N2 and P2, e.g., as implemented in a poly-silicon circuit, and with these three transistors having typical or normal threshold voltages, these problems are substantially avoided.

As used herein, the term "about" means that dimensions, sizes, formulations, parameters, shapes and other quantities and characteristics are not and need not be exact, but may be approximate and/or larger or smaller, as desired, reflecting tolerances, conversion factors, rounding off, measurement error and the like, and other factors known to those of skill in the art. In general, a dimension, size, formulation, parameter, shape or other quantity or characteristic is "about" or "approximate" whether or not expressly stated to be such.

While the present invention has been described in terms of the foregoing example embodiments, variations within the scope and spirit of the present invention as defined by the claims following will be apparent to those skilled in the art. For example, while embodiments are preferred to be embodied in an a-Si or in a polysilicon circuit, any other suitable circuit technology or semiconductor material(s) may be employed.

Further, pixel circuits 100', 100" are illustrated using p-channel transistors for transistors P1 and P2, and n-channel transistors for transistors N1 and N2. Pixel circuit 100', 100" could be implemented using the opposite polarity for all four transistors, in which case the OLED element cathode (rather than its anode) would be connected to the n-channel transistors in the position of transistor P2, which is not typically done in OLED technology.

Also alternatively, any combination of one or more of transistors N1, N2, or P2 could be made using transistors of the opposite polarity from that shown, without changing the direction of the OLED, since these three transistors are just used as switches (unlike transistor P1, which acts as the current driver and must therefore have the OLED element in its drain circuit). Because changing the polarity of any of these three transistors N1, N2, and/or P2 would require that the polarity of its gate drive signal be inverted, it would probably be more likely in a typical case that the polarity of all three transistors would be changed in the interest of simplifying the drive signal requirement and retaining a single select line S.

What is claimed is:

1. A pixel circuit for an OLED element comprising:

an OLED element;

first and second transistors of a first polarity, each of said first and second transistors having a controllable conduction path and a control electrode for controlling the conduction of said controllable conduction path, wherein one end of the controllable conduction paths of said first and second transistors are connected together for receiving a data signal current, and wherein the control electrodes of said first and second transistors are connected to each other for receiving a select signal for being enabled thereby;

third and fourth transistors each having a controllable conduction path and a control electrode for controlling the conduction of said controllable conduction path, at least one of said third and fourth transistors exhibiting a capacitance between its control electrode and its conduction path, wherein one end of the controllable conduction paths of said third and fourth transistors are connected together and to an OLED element;

wherein the control electrodes of said third and fourth transistors are connected to each other and to the other end of the controllable conduction path of said first transistor; and wherein the other end of the controllable conduction path of said third transistor is connected to the other end of the controllable conduction path of said second transistor;

whereby a current is established in the OLED element responsive to the data signal current when said first and second transistors are enabled by the select signal.

2. The pixel circuit of claim 1 further comprising a capacitance coupled between the one end of the controllable conduction path of said fourth transistor and the control electrode thereof.

3. The pixel circuit of claim 1 wherein said third and fourth transistors are of the first polarity.

4. The pixel circuit of claim 1 wherein the one ends of the controllable conduction paths of said third and fourth transistors are connected to the anode of the OLED element, and wherein a cathode of the OLED element and the other end of the controllable conduction path of said fourth transistor are coupled for receiving a potential therebetween.

5. The pixel circuit of claim 1 in combination with a plurality of like pixel circuits arranged in rows and columns to define a display having a plurality of OLED pixel elements.

6. The display of claim 5 further comprising row conductors associated with pixel circuits in each row of said display and column conductors associated with pixel circuits in each column of said display.

7. The display of claim 6 wherein said column conductors apply the data signal current and said row conductors apply the select signal.

8. The pixel circuit of claim 1 embodied in an amorphous-silicon circuit, in a poly-silicon circuit, or in a single-crystal silicon circuit.

9. A pixel circuit for an OLED element comprising:

an OLED element;

first and second transistors of a first polarity, each of said first and second transistors having a controllable conduction path and a control electrode for controlling the conduction of said controllable conduction path, wherein one end of the controllable conduction path of said first transistor is connected for receiving a data signal current, and wherein the control electrodes of said first and second transistors are connected to each other for receiving a select signal for being enabled thereby;

third and fourth transistors, each of said third and fourth transistors having a controllable conduction path and a control electrode for controlling the conduction of said controllable conduction path, at least said third transistor exhibiting a capacitance between its control electrode and its conduction path, wherein one end of the controllable conduction paths of said third and fourth transistors are connected together and to one end of the controllable conduction path of said second transistor;

wherein the control electrode of said third transistor is connected to the other end of the controllable conduction path of said first transistor;

wherein the control electrode of said fourth transistor is connected to the control electrodes of said first and second transistors for receiving the select signal for being enabled thereby;

wherein the other end of the controllable conduction path of said fourth transistor is connected to the OLED element; and wherein the other end of the controllable conduction path of said second transistor is coupled for receiving the data signal current, whereby a current is established in the OLED element responsive to the data signal current when said first, second and third transistors are enabled by the select signal.

10. The pixel circuit of claim 9 wherein the other end of the controllable conduction path of said second transistor is connected either to the one end or to the other end of the controllable conduction path of said first transistor.

11. The pixel circuit of claim 9 embodied in a poly-silicon circuit or in a single-crystal silicon circuit.

12. A pixel circuit for an OLED element comprising:

an OLED element;

first and second transistors of a first polarity, each of said first and second transistors having a controllable conduction path and a control electrode for controlling the conduction of said controllable conduction path, wherein one end of the controllable conduction paths of said first and second transistors are connected together for receiving a data signal current, and wherein the control electrodes of said first and second transistors are connected to each other for receiving a select signal for being enabled thereby;

third and fourth transistors, each of said third and fourth transistors having a controllable conduction path and a control electrode for controlling the conduction of said controllable conduction path, at least said third transistor exhibiting a capacitance between its control electrode and its conduction path, wherein one end of the controllable conduction paths of said third and fourth transistors are connected together and to the other end of the controllable conduction path of said second transistor;

wherein the control electrode of said third transistor is connected to the other end of the controllable conduction path of said first transistor;

wherein the control electrode of said fourth transistor is connected to the control electrodes of said first and second transistors for receiving the select signal for being enabled thereby; and wherein the other end of the controllable conduction path of said fourth transistor is connected to the OLED element;

whereby a current is established in the OLED element responsive to the data signal current when said first, second and third transistors are enabled by the select signal.

13. The pixel circuit of claim 12 further comprising a capacitance coupled between the other end of the controllable conduction path of said third transistor and the control electrode thereof.

14. The pixel circuit of claim 12 wherein said third and fourth transistors are of a second polarity opposite to the first polarity.

15. The pixel circuit of claim 12 wherein the other end of the controllable conduction path of said fourth transistor is connected to an anode of the OLED element, and wherein a cathode of the OLED element and the other end of the controllable conduction path of said third transistor are coupled for receiving a potential therebetween.

16. The pixel circuit of claim 12 in combination with a plurality of like pixel circuits arranged in rows and columns to define a display having a plurality of OLED pixel elements.

17. The display of claim 16 further comprising row conductors associated with pixel circuits in each row of said display and column conductors associated with pixel circuits in each column of said display.

18. The display of claim 17 wherein said column conductors apply the data signal current and said row conductors apply the select signal.

19. The pixel circuit of claim 12 embodied in a poly-silicon circuit or in a single-crystal silicon circuit.

20. A pixel circuit for an OLED element comprising:

an OLED element;

first and second transistors of a first polarity, each of said first and second transistors having a controllable conduction path and a control electrode for controlling the conduction of said controllable conduction path, wherein one end of the controllable conduction path of said first transistor is connected for receiving a data signal current, wherein the other end of the controllable conduction path of said first transistor is connected to one end of the controllable conduction path of said second transistor; and wherein the control electrodes of said first and second transistors are connected to each other for receiving a select signal for being enabled thereby;

third and fourth transistors, each of said third and fourth transistors having a controllable conduction path and a control electrode for controlling the conduction of said controllable conduction path, at least said third transistor exhibiting a capacitance between its control electrode and its conduction path, wherein one end of the controllable conduction paths of said third and fourth transistors are connected together and to the other end of the controllable conduction path of said second transistor;

wherein the control electrode of said third transistor is connected to the other end of the controllable conduction path of said first transistor;

wherein the control electrode of said fourth transistor is connected to the control electrodes of said first and second transistors for receiving the select signal for being enabled thereby; and wherein the other end of the controllable conduction path of said fourth transistor is connected to the OLED element;

whereby a current is established in the OLED element responsive to the data signal current when said first, second and third transistors are enabled by the select signal.

21. The pixel circuit of claim 20 further comprising a capacitance coupled between the other end of the controllable conduction path of said third transistor and the control electrode thereof.

22. The pixel circuit of claim 20 wherein said third and fourth transistors are of a second polarity opposite to the first polarity.

23. The pixel circuit of claim 20 wherein the other end of the controllable conduction paths of said fourth transistor is connected to an anode of the OLED element, and wherein a cathode of the OLED element and the other end of the controllable conduction path of said third transistor are coupled for receiving a potential therebetween.

24. The pixel circuit of claim 20 in combination with a plurality of like pixel circuits arranged in rows and columns to define a display having a plurality of OLED pixel elements.

25. The display of claim 24 further comprising row conductors associated with pixel circuits in each row of said display and column conductors associated with pixel circuits in each column of said display.

26. The display of claim 25 wherein said column conductors apply the data signal current and said row conductors apply the select signal.

27. The pixel circuit of claim 20 embodied in a polysilicon circuit or in a single-crystal silicon circuit.

* * * * *